United States Patent [19]

Ishida

[11] Patent Number: 4,611,102

[45] Date of Patent: Sep. 9, 1986

[54] SWITCH DEVICE FOR ANGULARLY ADJUSTING OUTER REAR MIRRORS OF AN AUTOMOTIVE VEHICLE

[75] Inventor: Shoji Ishida, Iwakura, Japan

[73] Assignee: Takao Ooi wa, Niwa, Japan

[21] Appl. No.: 686,927

[22] Filed: Dec. 27, 1984

[30] Foreign Application Priority Data

Dec. 28, 1983 [JP] Japan ..... 58-203477

[51] Int. Cl.[4] ..... H01H 9/26

[52] U.S. Cl. ..... 200/5 R; 200/50 C; 350/637

[58] Field of Search ..... 350/637; 200/5 E, 50 C, 200/5 R, 4

[56] References Cited

U.S. PATENT DOCUMENTS

| | | | |
|---|---|---|---|
| 2,916,566 | 12/1959 | Meyer et al. | 200/5 R |
| 3,207,862 | 9/1965 | Robbins | 200/50 C X |
| 4,297,541 | 10/1981 | Niinuma | 200/5 E |
| 4,499,342 | 2/1985 | Nakayama | 200/5 E |

*Primary Examiner*—A. D. Pellinen
*Assistant Examiner*—Morris Ginsburg
*Attorney, Agent, or Firm*—Cushman, Darby & Cushman

[57] ABSTRACT

Four push portions are provided in a switch knob in a switch case. Four pairs of opposed contact switches are disposed in the switch case and opposed to the push portions. A blocking member for preventing the push portions from being pushed in are also provided in the switch case. When one of the push portions is pushed in, the other push portion opposite to the one push portion is mechanically prevented from being simultaneously pushed in.

2 Claims, 9 Drawing Figures

SWITCH DEVICE FOR ANGULARLY ADJUSTING OUTER REAR MIRRORS OF AN AUTOMOTIVE VEHICLE

BACKGROUND OF THE INVENTION (1) Field of the Invention

The present invention relates to a switch device for remote-controlling motors which angularly adjust outer rear view mirrors in vertical and horizontal directions.

(2) Description of the Prior Art

In a switch device for angularly adjusting outer rear view mirrors of an automotive vehicle in vertical and horizontal directions, an approximately plane switch knob is divided into four push portions and the motors are energized by push operation of each push portion whereby the outer rear view mirrors are angularly adjusted.

In the prior art, however, a plurality of push portions are inherently pushed in simultaneously. For example, when the motor for angularly adjusting the mirror in the vertical direction and the motor for angularly adjusting the mirror in the horizontal direction are electrically connected through a switch means, a power source short-circuits or the motors cease to be energized if the push portion for motion in the upward direction and the motor for motion in the downward direction are simultaneously pushed in or if the push portion for motion in the left direction and the motor for motion in the right direction are simultaneously pushed in. In order to prevent the above case a preferential circuit is disposed between the switch means and the motors. The preferential circuit selectively effectuates one push portion when two of the push portions are simultaneously pushed in.

The above construction, however, requires a complicated electric circuit which brings rise of production cost.

SUMMARY OF THE INVENTION

In view of the prior art described above, including the disadvantages and deficiencies of prior art switch device for angularly adjusting outer rear view mirrors of an automotive vehicle, it is an object of the invention to provide a switch device which mechanically prevents two push portions opposite to each other from being simultaneously pushed in without using a preferential circuit.

The switch device of the present invention has an approximately plane switch knob which is divided into four push portions with its central part. In a switch case four pairs of opposed contact switches are disposed. Each pair is opposed to each of the push portions and closed by push operation of each push portion. A blocking member slidably moves along a plane approximately parallel to the switch knob in the switch case. Around the blocking member four blocking portions opposed to the push portions are integrally formed. When one of the push portions is pushed in, the blocking member slidably moves and one of the blocking portions prevents the other push portion opposite to the push portion from being simultaneously pushed in.

According to the switch device of the present invention, it is unnecessary to provide a preferential circuit because the push portions opposite to each other can mechanically be prevented from being simultaneously pushed in. In consequence the electric circuit can be simplified and thereby production cost can be lowered.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DESCRIPTION OF THE PREFERRED EMBODIMENT

Figure 8:
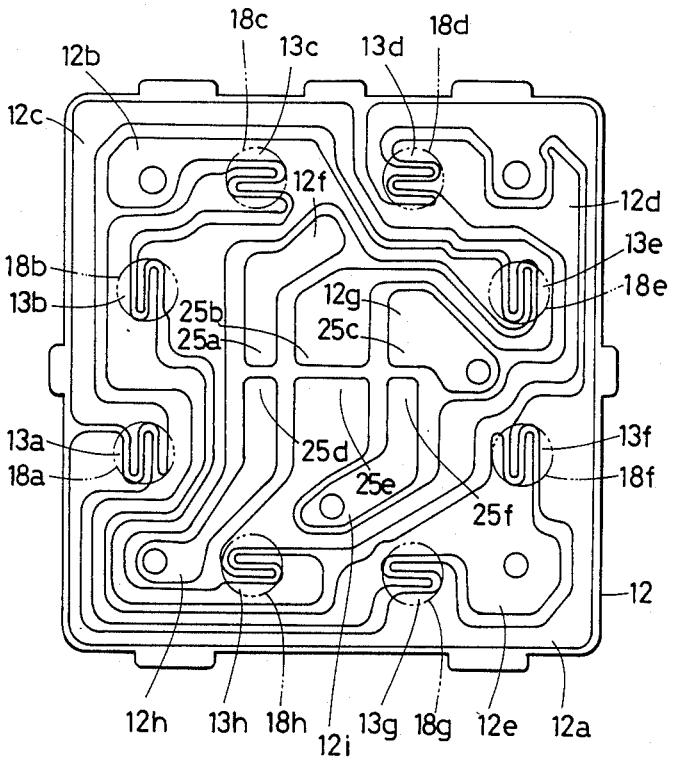
FIG. 8 is a plan view of an insulating substrate.

Referring now to the drawings, a rectangular switch case 1 includes a flange portion 2 with a step portion 1*a* formed inside the front edge of the switch case 1. A plurality of collars 3*b* are formed from the end of a side wall 3*a* formed along the outer edge of a switch knob 3 having a rectangular opening 4 in its central part. The switch knob 3 is provided at the front side of the switch case 1 and the collars 3*b* engage the step portion 1*a*. The front side of the switch knob 3 is divided into four push portions 6 through 9 by four partition lines 5 on the diagonal lines. Marks 10 are formed on the push portions 6 through 9. Four pairs of cylindrical members 11 opposed to the push portions 6 through 9 project at the back side of the switch knob 3. On the upper surface of an insulating substrate 12 made of a printed substrate and fixed to the back side of the switch case 1, eight pairs of fixed contacts 13*a* through 13*h* are disposed as shown in FIG. 8.

Contact holder members 14 made of such an elastic element as sillicone rubber are disposed in pile on the insulating substrate 12. On the contact holder members 14 thin portions 15 are formed. Short cylindrical movable members 16 are formed on the thin portions 15. The movable members 16 are normally spaced from fixed contacts 13 by the elastic force of the thin portions 15. The conductive element such as carbon is applied to the under surface of each movable contact 17. Thus opposed contact switches 18*a* through 18*h* consist of the movable contacts 17 and the fixed contacts 13*a* through 13*h*. Each pair of the cylindrical members 11 is disposed at the back side of each push portions 6 through 9 and each pair of opposed contact switches 18*a* through 18*h* is opposed to each cylindrical member 11, that is, the push portion 6 is opposed to the switches 18*a* and 18*b*, the push portion 7 to the switches 18*c* and 18*d*, the push portion 8 to the switches 18*e* and 18*f* and the push portion 9 to the switches 18*g* and 18*h*.

An inner case 19 is formed integrally with a rectangular support frame 21 through four ribs 20 disposed along the diagonal lines of the switch case 1. The support frame 21 is fixed to the inside of the switch case 1. A movable contact holder 22 is slidably disposed in the inner case 19 by which movable contacts 24*a* and 26*b* are supported through springs 23 and 23 therebetween. On the insulating substrate 12 a plurality of, for example six, fixed contacts 25*a* through 25*f* are disposed.

Figure 4:
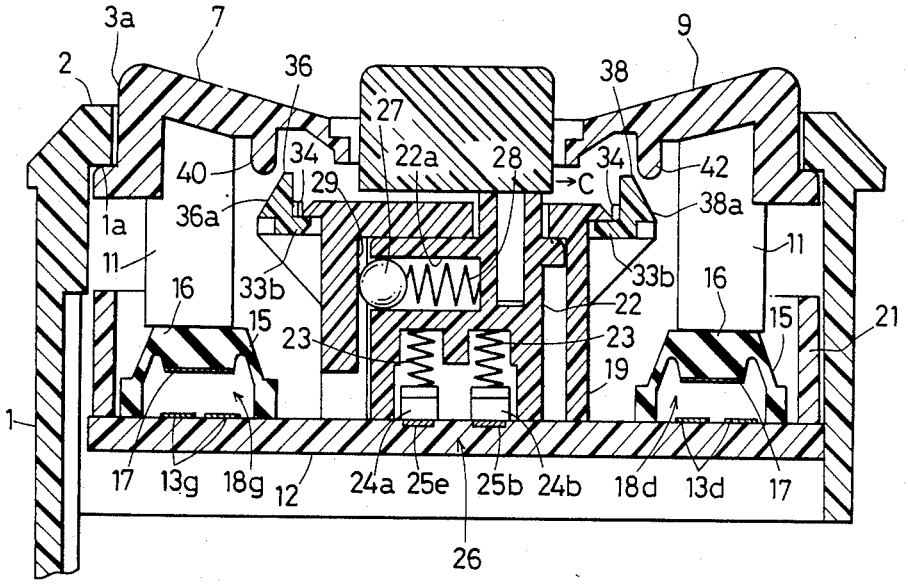
FIG. 4 is a sectional view taken along the line IV—IV in FIG. 1.
Figure 5:
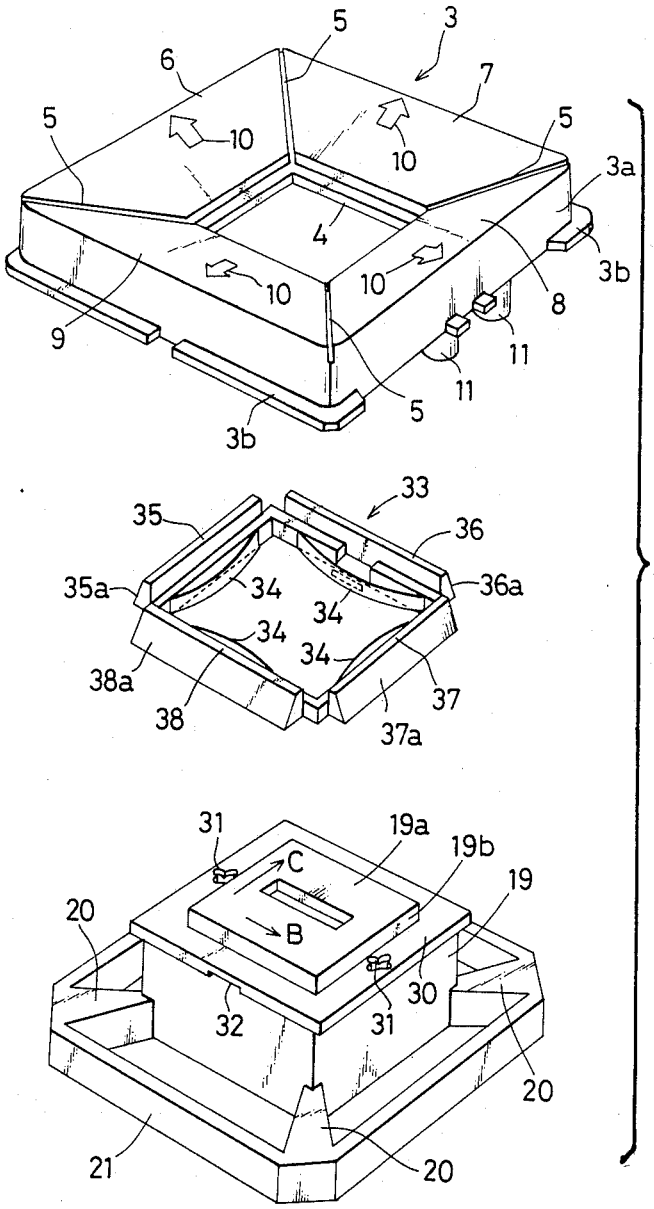
FIG. 5 is an exploded perspective view of the switch device of the invention.
Figure 6:
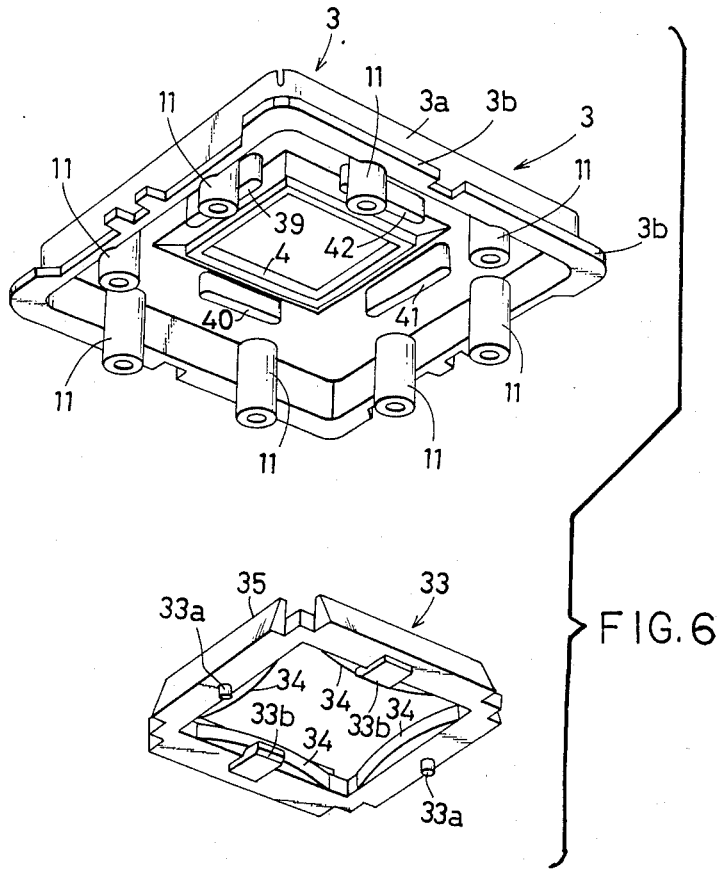
FIG. 6 is an exploded perspective view taken in a different direction from that of FIG. 5.

A slide switch 26 consists of the movable contacts 24*a* and 24*b* and the fixed contacts 25*a* through 25*f* which are opposed to the movable contacts 24*a* and 24*b*. An opening 22*a* is formed in the movable contact holder 22 in which a detent ball 27 is disposed together with a spring 28. Three concave portions 29 (one of the three is shown in FIG. 4) are formed inside the inner case 19. A switch knob 22*b* projects through the opening 4 toward the front side of the switch case 1. The detent ball 27 is selectively brought into engagement with three concave portions 29 such that the switch knob 22 is displaced between the neutral position and the left or right position.

A rectangular guide member 30 extends around the front side 19*a* of the inner case 19 through a step portion 19*b*. The guide member 30 is approximately parallel with the insulating substrate 12 and the switch knob 3 in its neutral position. A pair of approximately cruiciform blocking openings 31 and 31 are formed through the guide member 30. A pair of engaging concave portions 32 are formed at the back side of the guide member 30. A rectangular frame-shaped blocking member 33 is slidably disposed at the front side of the guide member 30. A pair of axles 33*a* and 33*a* projecting from the back side of the blocking member 33 are inserted into the pair of blocking openings 31 and 31. A pair of claws 33*b* and 33*b* engage the pair of concave portion 32 and thereby the blocking member 33 is prevented from being disconnected from the guide member 30.

Figure 1:
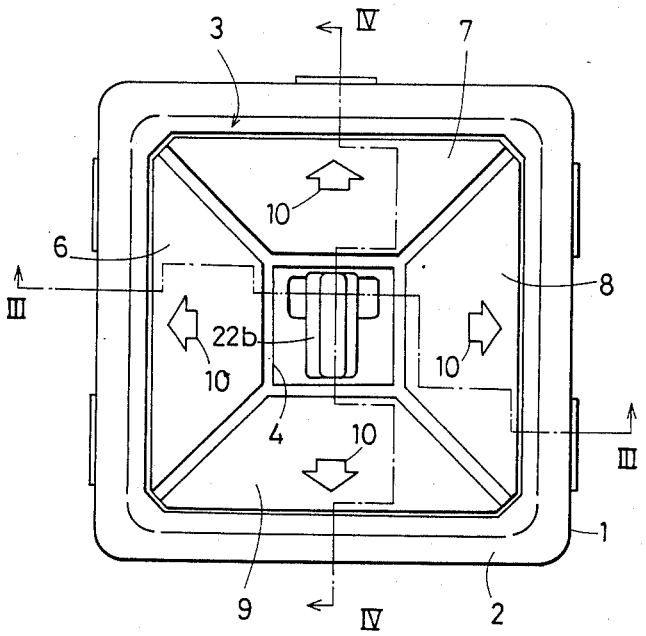
FIG. 1 is an elevational view of the switch device of the invention.
Figure 2:
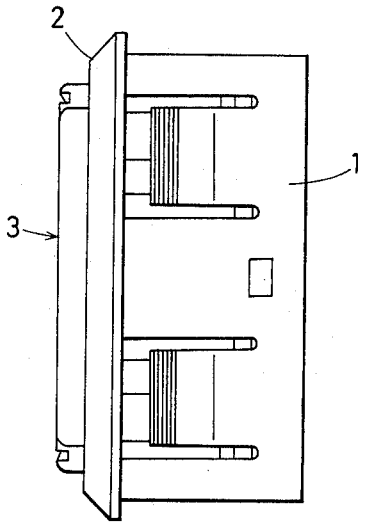
FIG. 2 is a right side view of the switch device of the invention.
Figure 3:
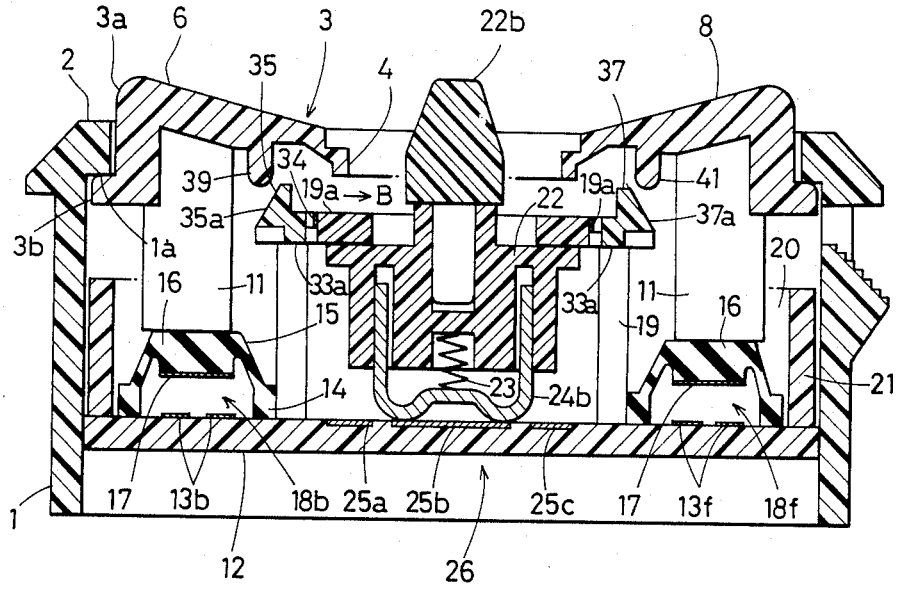
FIG. 3 is a sectional view taken along the line III—III in FIG. 1.

Both ends of approximately arc-shaped flat springs 34 which are respectively disposed inside the blocking member 33 are supported by the blocking member 33 and the central sections abut the step portion 19*b* of the inner case 19. Accordingly the inside part of the blocking member 33 is normally spaced from the step portion 19*b* as shown in FIGS. 1 and 2. Each axle 33*a* is positioned at the central part of each blocking opening 31 in the above-mentioned normal state. The blocking member 33 is formed integrally with the blocking portions 35 through 38. The blocking portions 35 through 38 respectively include taper-shaped guide surfaces 35*a* through 38*a* on the outside of of the blocking member 33. Projections 39 through 42 formed on the rear side of the switch knob 3 are respectively spaced from the blocking portions 35 through 38 when the switch knob 3 is in its neutral position and the blocking member 33 is in the aforementioned neutral position as shown in FIGS. 1 and 2.

In controlling the outer rear view mirrors of an automotive vehicle, the position of the movable contact holder 22 of the slide switch 26 is changed by operating the switch knob 22*b* whereby one of the mirrors to be controlled by the switch knob 3 is selected.

FIG. 8 illustrates wiring patterns printed on the insulating substrate 12, the arrangement of the fixed contacts 13*a* through 13*h* constructing the switches 18*a* through 18*h* and the fixed contacts 25*a* through 25*f* constructing the slide switch 26.

Figure 9:
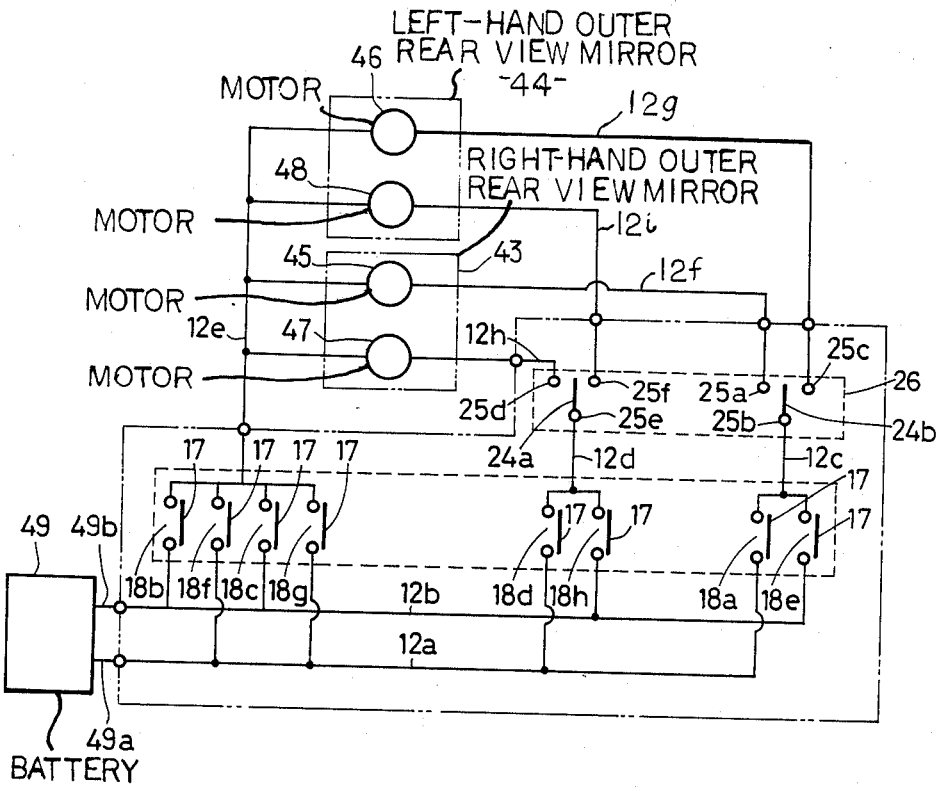
FIG. 9 is an electrical circuit diagram.

FIG. 9 shows an electrical circuit of the motors 45 and 46 for horizontal motion, the motors 47 and 48 for vertical motion of the outer rear view mirrors 43 and 44, and the switches 18*a* through 18*h* and the slide switch 26. As shown in FIG. 9, each pair of the switches 18*a* through 18*b*, 18*c* and 18*d*, 18*e* and 18*f*, and 18*g* and 18*h* is closed when each push portion 6 through 9 is pushed in. A printed pattern 12*a* interconnecting each one fixed contact of the switches 18*a*, 18*d*, 18*f* and 18*g* is connected to a positive terminal 49*a* of a storage battery 49, and a printed pattern 12*b* interconnecting each one fixed contact of the switches 18*b*, 18*c*, 18*e* and 18*h* is connected to a negative terminal 49*b* of the storage battery 49. A fixed contact 25*b* of the slide switch 26 and each of the other fixed contact of the switches 18*a* and 18*e* are interconnected in a printed pattern 12*c*. The fixed contact 25*e* of the slide switch 26 and each of the other fixed contact of the switches 18*d* and 18*h* are interconnected in a printed pattern 12*d*. A printed pattern 12*e* interconnecting each of the other fixed contact of the switches 18*b*, 18*c*, 18*f* and 18*g* is connected to each one terminal of the motors 45 through 48. The other terminal of the motor 45 is connected to a printed pattern 12*f* with a fixed contact 25*a* of the slide switch 26 formed at its one end. The other terminal of the motor 47 is connected to a printed pattern 12*h* with a fixed contact 25*d* of the slide switch 26 formed at its one end. The other terminal of the motor 48 is connected to a printed pattern 12*i* with a fixed contact 25*f* formed at its one end.

The switch device described above functions as follows.

Figure 7:
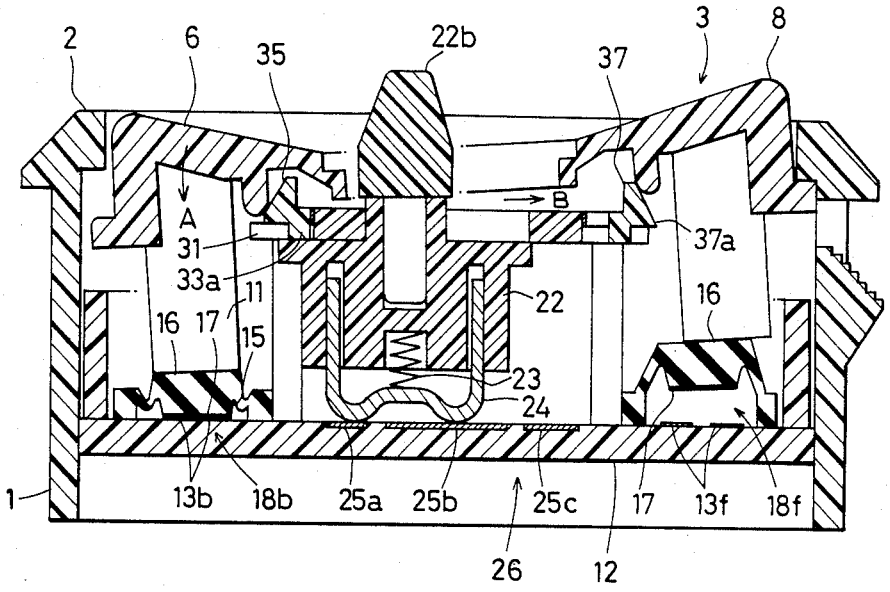
FIG. 7 is a sectional view illustrating the state in which one of the push portions is pushed in in FIG. 3.

The knob 22*b* of the slide switch 26 is switched in the left direction and thereby the section between the fixed contacts 25*d* and 25*e* and the section between 25*a* and 25*b* are respectively closed through the movable contacts 24*a* and 24*b* whereby the left-hand outer rear view mirror 43 is selected. In this case, for exampla, when the push portion 6 is pushed in in the direction of an arrow A as shown in FIG. 7, the movable member 16 opposed to the push portion 6 suffers from elastic deformation through the thin portion 15 by way of the cylindrical member 11. The movable contact 17 engages the fixed contacts 13*a* and 13*b* and the switches 18*a* and 18*b* opposed to the push portion 6 are closed, and the motor 47 is energized. The outer rear view mirror 43 is angularly adjusted in the direction indicated by the mark 10 on the push portion 6.

When the push portion 6 is pushed in, the projection 39 pushes the guide surface 35*a* of the blocking portion 35. The blocking member 33 is forced to slidably move in the direction of an arrow B against the elastic force of the flat spring 34 and the guide surface 37*a* of the blocking portion 37 engages the projection 41 whereby the push portion 8 is prevented from being simultaneously pushed in and accordingly the switches 18*e* and 18*f* are prevented from being simultaneously closed.

When the blocking member 33 is slidably moved in the direction of the arrow B, the axle 33*a* also moves in the same direction and puts into the end of the blocking opening 31 whereby the blocking member 33 is prevented from moving in the direction perpendicular to the arrow B, that is, in the direction of an arrow C or opposite to the arrow C. In this case, when the push portion 7 or 9 is pushed in, the projections 40 or 42 moves until abutting the blocking portion 36 or 38, but further pushing of the push portion 7 or 9 is prevented because the blocking member 33 is prevented from moving in the direction of the arrow C or opposite to the arrow C by the axle 33*a* and the blocking opening 31. In consequence the switches 18*c* and 18*d*, and 18*g* and 18*h* are prevented from being closed.

When the push portions 6 and 8 are simultaneously pushed in, the projections 39 and 41 simultaneously abut the guide surface of the blocking portions 35 and 37, and the blocking member 33 moves neither in the direction of the arrow B nor in the direction opposite to the arrow B whereby the push portions 6 and 8 are prevented from being further pushed in and the switches 18*a* and 18*b*, and 18*e* and 18*f* are prevented from being closed.

When the other push portions 7 through 9 are pushed in separately, the blocking member prevents the other push portions except the one pushed in from being simultaneously pushed in as in the case where the push portion 6 is pushed in.

When the push portions 7 and 9 are simultaneously pushed in, the switches 18*c* and 18*d*, and 18*g* and 18*h* are prevented from being closed. When each one of the push portions 6 through 9 is pushed in, the switch opposed to the push portion pushed in is closed and the other switches respectively opposed to the other push portions are prevented from being closed.

The slide switch 26 may be eliminated if desired. Besides remote-controlling of the outer rear view mirrors of an automotive vehicle, the switch device of the present invention can be used for other purposes, for example, for moving a cursor of a personal computer.

The axle 33*a*, the blocking opening 31 and the flat spring 34 may be eliminated if desired. Even in case that the above three members are eliminated, two adjacent push portions such as the push portions 7 and 8 can not simultaneously be pushed in whereby all of the switches 18*c* and 18*d*, and 18*e* and 18*f* can not be simultaneously closed, and particularly the switch 18*c* and the switch 18*f* can not simultaneously be closed so that the battery 40 never short-circuits.

Although the present invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A switch device for angularly adjusting outer rear view mirrors of an automotive vehicle comprising:

(a) an outer case having a front side with an opening of approximately rectangular shape;

(b) a first switch knob having an approximately rectangular front side, a central opening and four push portions formed between the outer and inner periphery thereof on the approximately rectangular front side, said first switch knob being mounted in the outer case so that said push portions are disposed in the opening and supported therein and so that said first switch knob is inclined to actuate said device when one of said push portions is depressed and returns to the original position when the depressed push portion is released;

(c) first switches provided in the outer case in opposed relation to the back side of the push portions so as to be operated when the switch knob is inclined for actuation, said first switches being adapted for connection with motors for controlling right-hand and left-hand rear view mirrors of an automotive vehicle;

(d) an inner case mounted in the outer case in a position opposed to said central opening such that said switches are positioned around said inner case and having a central opening formed in a front wall opposed to the opening of said switch knob;

(e) a second switch for selectively connecting said motors for driving the right-hand outer rear view mirrors or driving the left-hand outer rear view mirrors with said first switches;

(f) a second switch knob for operating said second switch, said second switch knob projecting through the central opening of the first switch knob and said opening formed in the front wall of the inner case opposed to the opening of the second switch knob;

(g) a blocking member of approximately rectangular configuration adapted to move in a first direction and in a second direction perpendicular to the first direction and in a plane perpendicular to the direction in which the first switch knob is depressed and having slanting guiding surfaces formed on the periphery thereof corresponding to the outer periphery of said first switch knob; and (h) a guiding member projecting around the vicinity of the front side wall of the inner case for guiding movement of said blocking member;

projections being provided at the back side of the first switch knob and opposed to the slanting guide surfaces of the blocking member with an appropriate gap therebetween in the normal position, whereby one of said guide projections moves to one of said slanting guide surfaces when one of the push portions is depressed and whereby the blocking member is moved due to reaction movement of the projection so that the projection placed opposite approaches close to the corresponding guide surface to prevent depression of any of the other push portions.

2. A switch device as set forth in claim 1 wherein said guiding member has concave portions formed on the back side of one opposed pair of sides thereof and wherein said blocking member has claws slidably engageable with said concave portions, thereby preventing the blocking member from being disengaged from the guiding member.

* * * * *